US008286283B2

(12) United States Patent
Copeland et al.

(10) Patent No.: US 8,286,283 B2
(45) Date of Patent: Oct. 16, 2012

(54) LATERAL SUPPORT FOR AN OPERATING TABLE

(75) Inventors: John Robert Copeland, Bayswater (AU); Noel Robert Hughes, Bayswater (AU)

(73) Assignee: Surgipod Pty. Ltd., Bayswater, VIC (AU)

( * ) Notice: Subject to any disclaimer, the term of this patent is extended or adjusted under 35 U.S.C. 154(b) by 678 days.

(21) Appl. No.: 11/568,980

(22) PCT Filed: May 12, 2005

(86) PCT No.: PCT/AU2005/000732
§ 371 (c)(1),
(2), (4) Date: Dec. 28, 2006

(87) PCT Pub. No.: WO2005/107676
PCT Pub. Date: Nov. 17, 2005

(65) Prior Publication Data

US 2008/0034502 A1 Feb. 14, 2008

(30) Foreign Application Priority Data

May 12, 2004 (AU) ..... 2004902553

(51) Int. Cl.
*A47B 7/00* (2006.01)

(52) U.S. Cl. ..... 5/621; 5/624; 5/622; 5/652; 5/658; 128/845

(58) Field of Classification Search ..... 5/621, 624, 5/622, 662, 623, 652, 657, 503.1, 658; 128/845; 248/122.1, 123.11, 585, 291.1, 292.12, 284.1; 269/45, 71, 73, 74, 81; 108/49
See application file for complete search history.

(56) References Cited

U.S. PATENT DOCUMENTS 2,535,559 A * 12/1950 Wolf ..... 5/630
4,526,355 A * 7/1985 Moore et al. ..... 5/624
4,702,465 A 10/1987 McConnell
4,766,892 A * 8/1988 Kreitman ..... 5/624
(Continued)

FOREIGN PATENT DOCUMENTS

DE 3908824 9/1990
(Continued)

OTHER PUBLICATIONS

Australian Patent Office, International Search Report for PCT/AU2005/000732, Jul. 8, 2005, p. 1-3.

*Primary Examiner* — Robert G Santos
*Assistant Examiner* — Brittany Wilson
(74) *Attorney, Agent, or Firm* — William E. Eshelman

(57) ABSTRACT

A patient positioning support for an operating theatre table (2) has a saddle (18) for clamping to the rail (8) which runs alongside the edge of the table and a pair of articulating arms (26, 32) attached to the saddle for holding a pad in contact with a patients body or limb. The devices are mounted in pairs and are lockable in positions which overlie the tame or lie outboard of the table or below the table when not required. The locking action is by friction but radial arrays of teeth (66, 68), which are locked by hand screws (62), give the preferred locking action. Other items of equipment such as arm boards, neural head supports and stirrups can be substituted for the pad.

32 Claims, 9 Drawing Sheets

U.S. PATENT DOCUMENTS

| | | | | |
|---|---|---|---|---|
| 5,360,337 | A * | 11/1994 | Westdyk | 433/64 |
| 5,362,021 | A * | 11/1994 | Phillips | 5/507.1 |
| 5,390,383 | A | 2/1995 | Carn | |
| 5,806,117 | A | 9/1998 | Gotfried | |
| 5,909,733 | A * | 6/1999 | Ehrich | 128/869 |
| 5,926,878 | A * | 7/1999 | Morton et al. | 5/624 |
| 6,151,734 | A * | 11/2000 | Lawrie | 5/622 |
| 6,260,220 | B1 * | 7/2001 | Lamb et al. | 5/621 |
| 6,298,507 | B1 | 10/2001 | Clyburn | |
| 6,502,261 | B1 | 1/2003 | Harwood | |
| 6,505,365 | B1 * | 1/2003 | Hanson et al. | 5/662 |
| 6,615,429 | B2 | 9/2003 | Graham et al. | |
| 6,622,324 | B2 | 9/2003 | VanSteenburg et al. | |
| 6,629,944 | B2 * | 10/2003 | Smart | 128/845 |
| 6,671,905 | B2 * | 1/2004 | Bartlett et al. | 128/845 |
| 6,718,581 | B2 | 4/2004 | Riach | |
| 6,820,621 | B2 * | 11/2004 | DeMayo | 128/845 |
| 7,093,313 | B2 * | 8/2006 | DeBraal et al. | 5/622 |
| 7,124,755 | B2 * | 10/2006 | Van Hooser | 128/845 |
| 7,182,084 | B2 * | 2/2007 | Cleveland | 128/845 |
| 7,219,684 | B2 * | 5/2007 | Dabir et al. | 251/284 |
| 7,234,180 | B2 * | 6/2007 | Horton et al. | 5/622 |
| 7,422,016 | B2 * | 9/2008 | Klemm | 128/845 |
| 7,544,007 | B2 * | 6/2009 | Easton | 5/622 |
| 7,552,492 | B2 * | 6/2009 | Rolfes et al. | 5/622 |
| 7,552,733 | B1 * | 6/2009 | Schubert, III | 128/845 |
| 7,832,803 | B2 * | 11/2010 | Cassaday | 297/408 |
| 2002/0138906 | A1 * | 10/2002 | Bartlett et al. | 5/609 |
| 2002/0170116 | A1 * | 11/2002 | Borders et al. | 5/618 |
| 2003/0178027 | A1 * | 9/2003 | DeMayo | 128/845 |
| 2004/0123389 | A1 * | 7/2004 | Boucher et al. | 5/623 |
| 2004/0133979 | A1 * | 7/2004 | Newkirk et al. | 5/623 |
| 2006/0162076 | A1 * | 7/2006 | Bartlett et al. | 5/607 |
| 2006/0185092 | A1 * | 8/2006 | McFadden | 5/622 |
| 2009/0145443 | A1 * | 6/2009 | Dreyfuss | 128/845 |
| 2009/0293884 | A1 * | 12/2009 | Dasilva | 128/845 |
| 2010/0018537 | A1 * | 1/2010 | Soto et al. | 128/845 |

FOREIGN PATENT DOCUMENTS

| | | | |
|---|---|---|---|
| DE | 3908824 | A1 | 9/1990 |
| DE | 4138317 | A1 | 5/1993 |
| EP | 1467692 | | 10/2004 |
| GB | 190916426 | | 0/1910 |
| GB | 191000358 | | 0/1911 |
| RU | 2161942 | | 1/2001 |
| WO | WO9835643 | A2 | 8/1998 |
| WO | WO03077820 | | 9/2003 |

* cited by examiner

LATERAL SUPPORT FOR AN OPERATING TABLE

FIELD OF THE INVENTION

This invention concerns patient positioning supports for assisting the retention of patients on operating tables.

BACKGROUND OF THE INVENTION

Part of the preparation for an operation is the transfer of the patient from a trolley to the table and the placement of the patient in a suitable position for the surgeon. Whatever the body position of the patient for the surgery that is vertical, dorsal or lateral, the patient must be moved to the dorsal supine position if there is cardiac or pulmonary arrest. This change must occur as quickly as possible. Heavy patients require considerable effort to rearrange in this way. The sites of the support pads used to maintain the operating position must be changed also and if they are taken away to permit unimpeded resuscitation the patient sometimes falls off the table. Back injury is accordingly a hazard for theatre staff and slow adjustability of support pads is a hazard for patients.

Earlier proposals have suggested superstructure for the table beneath which the patient is arranged or brackets which are adjustable toward and away from the patient. In U.S. Pat. No. 6,622,324, a pair of concave pads are provided on the end of arms which extend from the side of the operating table. The arms are substantially central and place the pads on the patients hips. A further pair of arms extend from the head end of the table and the pads of these arms contact the patients shoulders so that during operations wherein the table tilts to bring the patients head lower than the patients feet to give the surgeon a view of the nose or throat, the supports are designed for this position. The supports are not part of a system which is capable of adjustment to help the surgeon arrange the torso and limbs of a patient for the variety of positions needed to give surgical access.

The patient support device which is known most widely in operating theatres is the Moore device shown in the accompanying drawings marked Prior Art. The device has a saddle mounted on the table rail which supports a fixed upright post from which an arm extends horizontally across the table mattress upon which the patient lies. The arm has a slide mount which supports an upright plate with a pad for contacting the patients body. A pinch screw locks the slide in the desired site. The pads lie inboard of the table edge and if the patient's body is wider than the table, effective placement is impossible, that is with a pair of pads lying mutually opposite with the patients body therebetween, without lifting the patient clear of the arm in order to remove the arm and reverse it.

If the patient is in the lateral position for the operation, the devices are useful but if the patient should arrest, the Moore device is difficult to adjust. The mass of the patient presses the arm into the mattress. If the pinch screw can be found beneath the drapes, the pad is difficult to retract because the patients mass presses the slide into the mattress. A member of the surgical team must raise the patient to release the arm so that the pad can be moved to the edge of the table allowing the patient to be rolled facing upwards in the supine position. One or more team members must lean over the patient and try to lift the torso and it is during these episodes, or even routine changes requested by the surgeon, that back injuries to the team have occurred. Arrests are sudden and the team must move the patient quickly to the resuscitation position.

Some surgical procedures evolve energetic manipulation of the patients limbs. Joints receiving a metal prosthesis must withstand mallet blows. The pinch screw may loosen during such vigorous movement and allow the patient to move. The pad cannot be raised or angled to suit the body shape of the patient. The pad cannot be quickly adjusted to lie beyond the width of the operating table.

An equally serious drawback is lack of height adjustment. Despite large variation in body sizes, only two standard height pads are provided to all theatres. It is common for the pad to stand too high and to thereby impede the surgeon's access. This is especially so with operations on the shoulder.

Patients must lie on the steel arm for the duration of the operation and suffer needless bruising.

The pinch screw is small and cannot easily be located when covered by surgical drapes. If the surgical team member lifts the drapes to find it or the clamp loosens spontaneously and falls to the floor, the drapes too may slide off. The operation must then be interrupted while replacement sterile drapes are brought and applied. This is an unwelcome expense in theatre work.

SUMMARY OF THE INVENTION

The apparatus aspect of the invention provides a patient support device for an operating theatre table having an integral rail alongside at least part of the table edge, the device comprising means to engage the rail, support means pivotally connected at one end to the rail and rail engagement means and at the opposite end to a pad for contacting the patients body, means for locking the supporting means in positions where the pad is overlying the table further from the table than the rail and below the table.

In a preferred embodiment, the support means is mounted on a permanent rail lying alongside the table edge. Operating tables normally have a perimeter rail already running parallel to the table perimeter and connected to it by spacers. The device can be secured at any position along the rail. Two pairs of devices are usually required for theatre work but more pairs can be mounted if necessary.

The rail engaging means for each device may be a saddle which engages the rail. The support itself may be a single arm. A pair of articulating arms are preferable because they allow height adjustment. The aim of the arrangement is to stow the support system out of the way of the theatre staff as far as possible by utilising the space below the table. This space is normally unoccupied except for the table pedestal and legs. The space alongside both edges and ends of the table must be vacant to ensure the theatre staff are able to stand as close as they wish to work on the patient. It is more useful if the adjustable support is made of two or more arms, one arm being pivoted to the slide, the other being pivoted to the pad and each arm being pivoted to the other. In this arrangement the slide moves to and fro on the rail and the entire linkage and pad rotate through 270° or so to lie underneath the table. More usually the device will hang vertically from the rail when not required. In this position a trolley or a table can be wheeled closer to the table than is possible with prior art devices.

The table is 400-500 mm wide. Accordingly the movement axially across the width of the table is about 210 mm from the edge of the table toward the centre longitudinal axis. This is achieved by changing the angle of articulation between the arms. For paediatric work the table may be smaller in size and the reach accordingly reduced.

The pivots may be of the type in which there are a pair of rings, each of which is connected to a pair of arms, the rings having inter-engageable teeth over 360° and a clamp which enables the user to clamp the rings at a desired angle of disposition.

The apparatus is made of sterilisable materials. The rails and linkages are made of metal alloys, preferably 316 stainless steel. The device may also be moulded in a polyamide such as nylon. The pads may be rectangular, convex-faced, gel-filled packs adhered to rectangular stainless steel plates. The shape and size of pads is conventional and may vary according to design, for example the plates and pads may be hexagonal.

As the aim of the apparatus is to move the pads across the table to where they are required and then to reverse them and park them clear of the table, persons skilled in the art will appreciate there are other geometries which will achieve the same purpose and we regard these as equivalents. For example, the pad may be supported by multiple criss-cross expanding links which keep the path of the pad parallel to the table top and allow it to rise and fall.

BRIEF DESCRIPTION OF THE DRAWINGS

One embodiment is now described by way of example with reference to the accompanying drawings, in which.

DETAILED DESCRIPTION WITH RESPECT TO THE DRAWINGS

Figure 1:
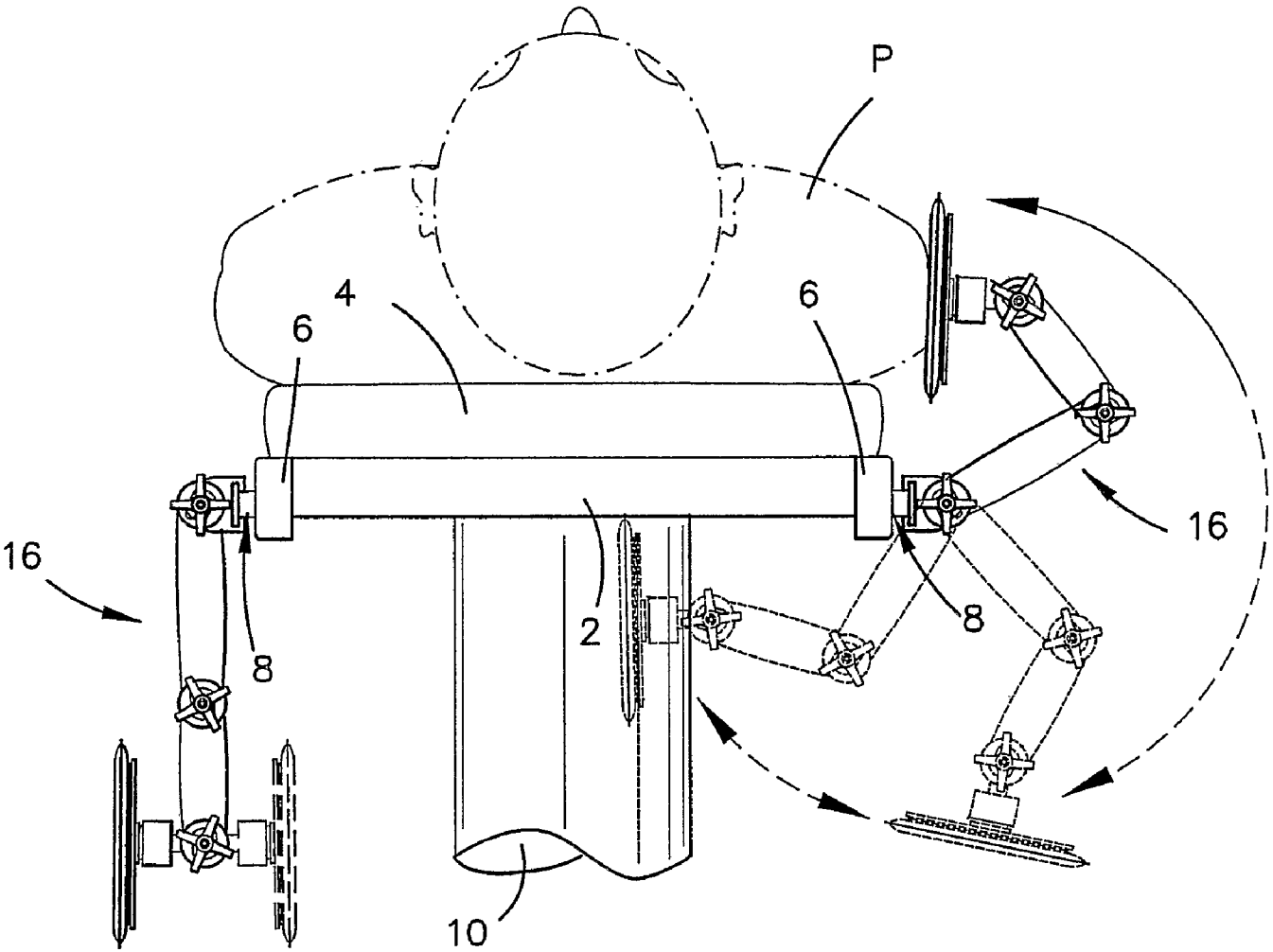
FIG. 1 is a general assembly including the operating table showing a typical working position for the devices and the stowed position.

Referring now to FIGS. 1, 2, 3 and 6, the operating table 2 is covered with a table mattress 4 and has sides 6 from which rail 8 (one shown) projects. The table is supported on a pedestal 10 but otherwise the space beneath the table is unoccupied. The rail is spaced from the table by steel spacers 12. Both rail and operating table have two gaps in their length but these are only about 12 mm wide. The table is covered by mattress 4. The table is commonly made of linked flat plates which articulate.

Figure 2:
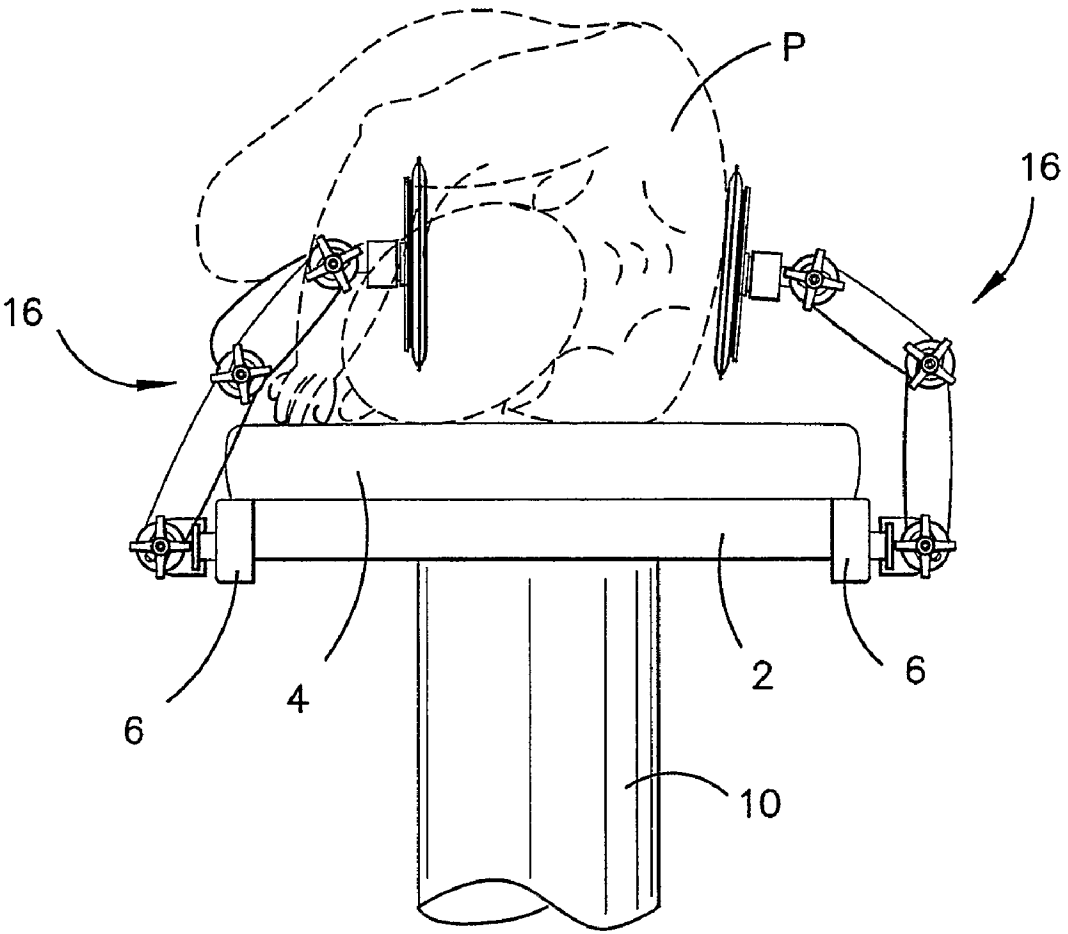
FIG. 2 is an end view of a patient supported in the lateral position.

In FIG. 1 the patient support device 16 is mounted on the LH rail 8 and the RH rail 8. The devices are shown supporting a patient P in the supine position. In FIG. 2 the patient P is in the lateral position with one arm overlying the head. Here the devices give dorsal and ventral support and are much closer together.

Figure 3:
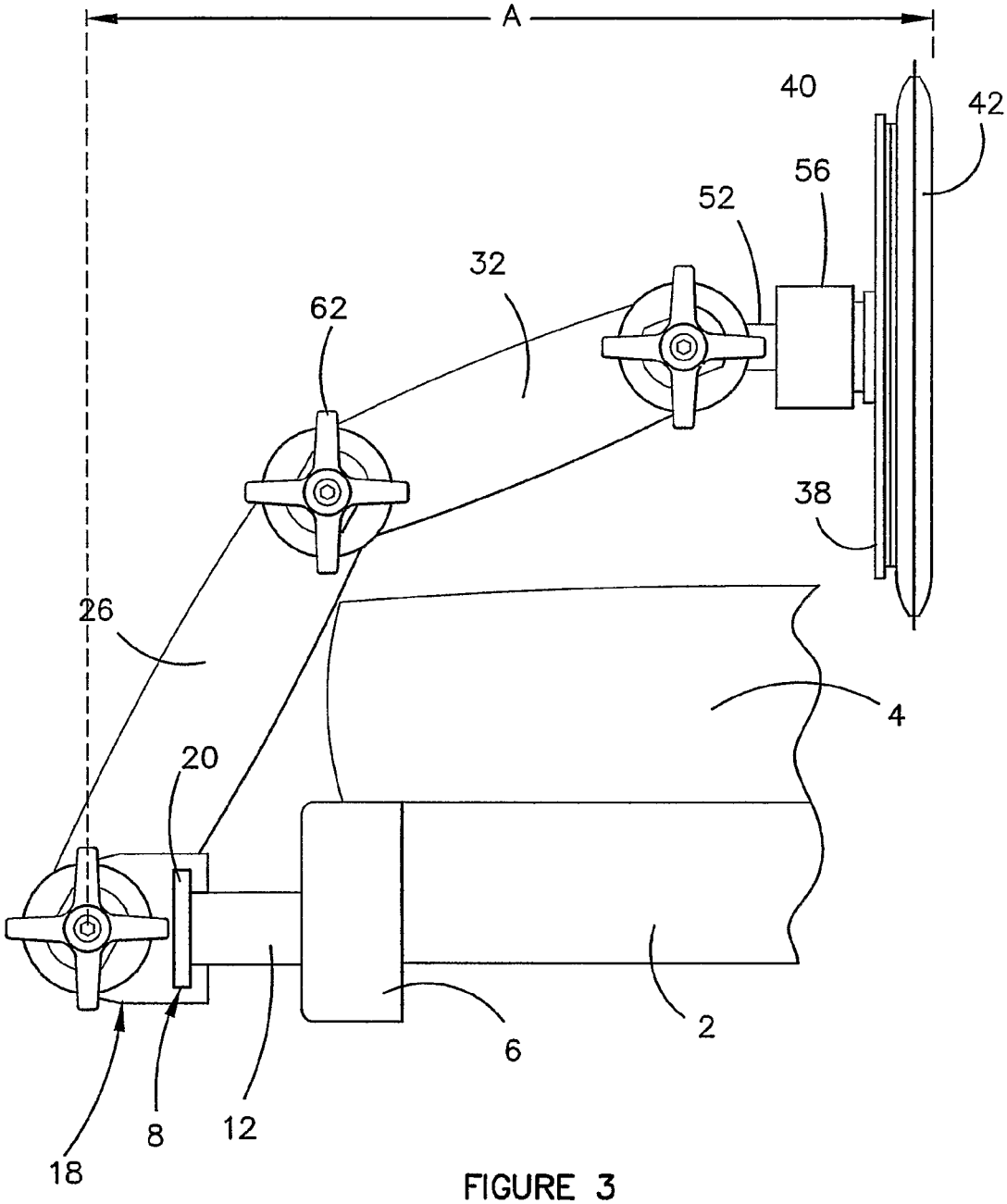
FIG. 3 is an end view of the devices in FIG. 1 in the inner most working position.
Figure 4:
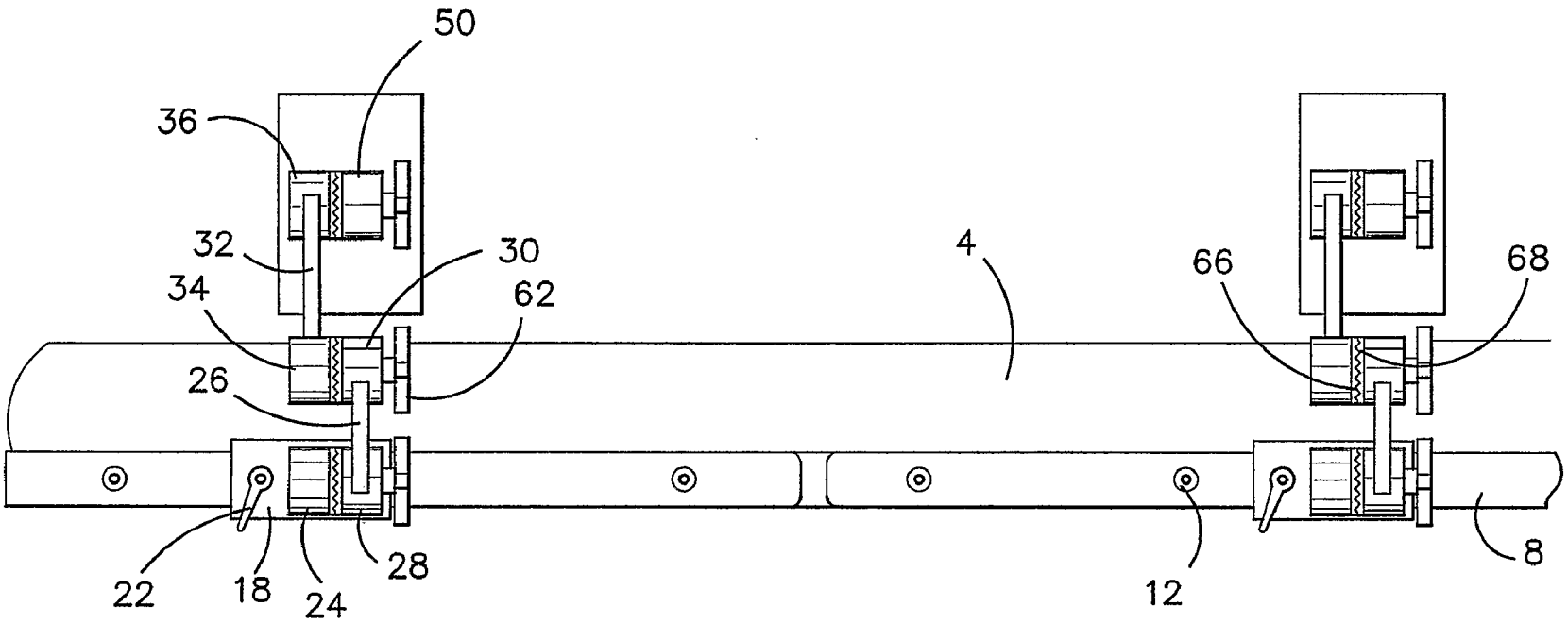
FIG. 4 is a side view of a pair of devices.

In FIGS. 2, 3 and 4 the parts of the device 16 which are made of 316 stainless steel are here clearly seen. Saddle 18 has a body with a T-section slot 20 which is a slide fit on rail 8. The body is long enough to safely bridge the 12 mm gaps. Lever clamp 22 allows saddle 18 to be locked to the rail. The saddle has an integral mounting ring 24 which mounts lower arm 26. Arm 26 has a ring 28 at the lower end and a ring 30 at its upper end. Upper arm 32 has a ring 34 at its lower end and a ring 36 at its upper end. Arm 26 has a fixed length. Arm 32 has a fixed length.

Pad Plate 38 has a front face 100×160 mm with VELCRO™ strips 40 for securing a silicone-filled pad 42. The maximum reach of the two arms together across the table is shown in FIG. 3 (266 mm). The rear face of pad plate 38 carries spigot 44, best seen in FIG. 5. Spigot 44 has a coarse exterior thread 46 and internal splines 48. Mounting ring 50 has a finger 52 with mating splines 54. Clamp nut 56 has a coarse interior thread 58 for clamping plate 38 to mounting ring 50 by reacting against shoulder 60. By separating splines 48 and 54, the plate can be rotated to a more useful position on the patients body or a more convenient position for the surgeon.

Figure 9:
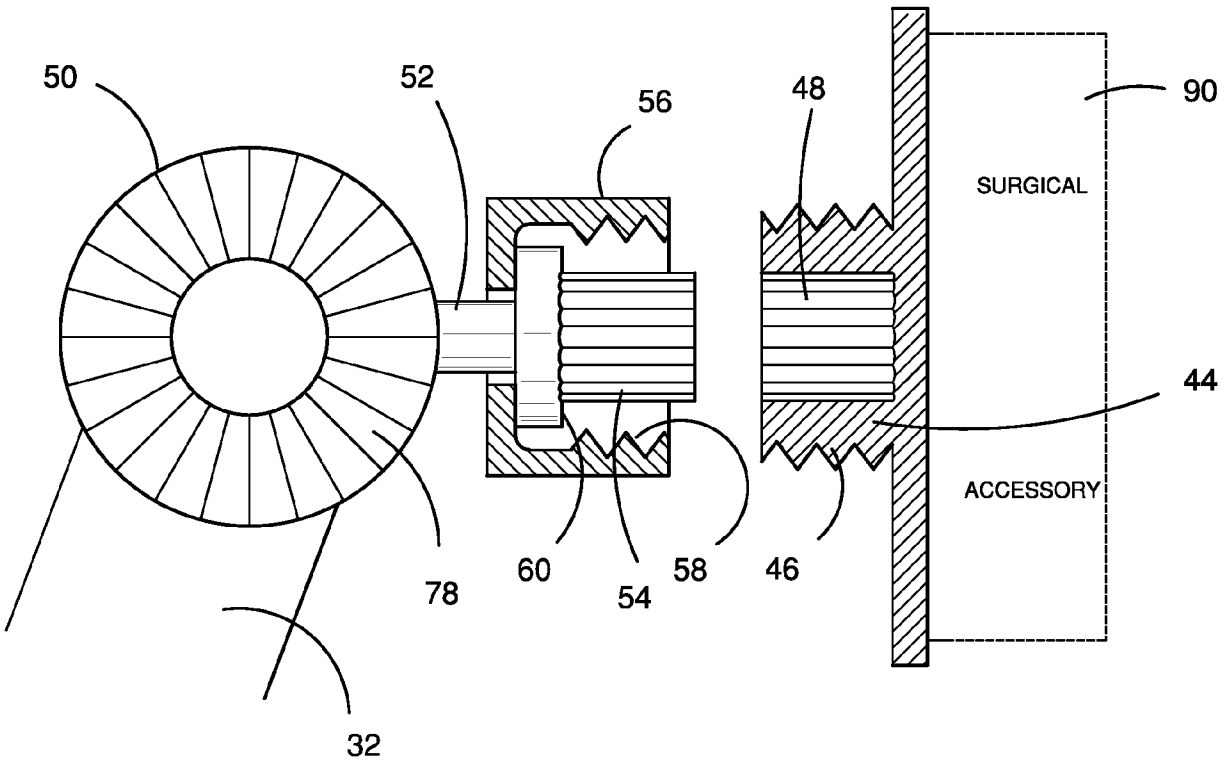
FIG. 9 is a partial sectional view of a surgical accessory and its connection to the device.

As seen in FIGS. 1-4, the lower arm 26, upper arm 32, and finger 52 are rotatable only about three mutually parallel axes. As also seen in FIGS. 1-4, the three mutually parallel axes are parallel to the longitudinal axis of the operating table 2. As the pad plate is detachable, the device can support a variety of ancillary equipment, all of which has a splined spigot 44 to connect with finger 52. In FIG. 9, the pad plate is substituted by a surgical accessory 90, for example, a neuro head rest, a camera, a footrest, an arm board, a hip frame, an arthroscopy frame, a stirrup, a varicose vein stripper or a laparotomy retractor.

Figure 6:
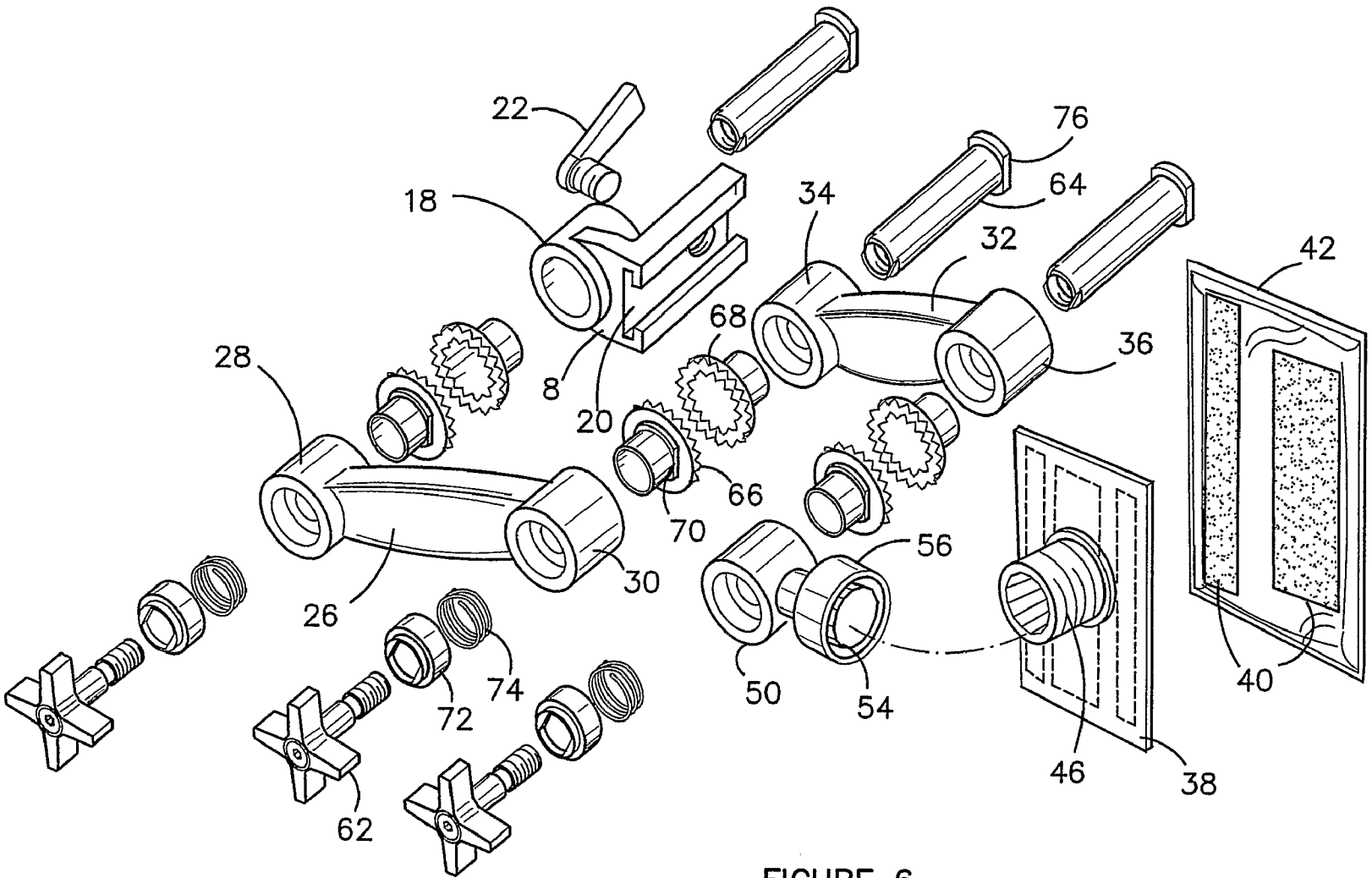
FIG. 6 is an exploded view of a single device.

In FIG. 6 the exploded view allows the locking means to be seen. As all three locking means are identical, only one will be described.

Hand screw 62 engages threaded sleeve 64 to clamp together rings 30, 34, thereby causing toothed rings 66 and 68 to inter-engage. Rings 66, 68 have flats 70 (one shown) which cause them to lock to the rings 30 and 34 respectively.

Hand screw compresses collar 72 against coil spring 74 which reacts against toothed ring 66 but if hand screw 62 is slack when arms 26 and 32 are rotated, the toothed rings slip over one another emitting a ratchet sound. Flats 76 on sleeve 64 allow the screw to tighten, forcing the toothed rings to lock together, fixing the angular dispositions of the arms. Coil spring 74 exerts continuous engagement pressure on the toothed rings.

Figure 5:
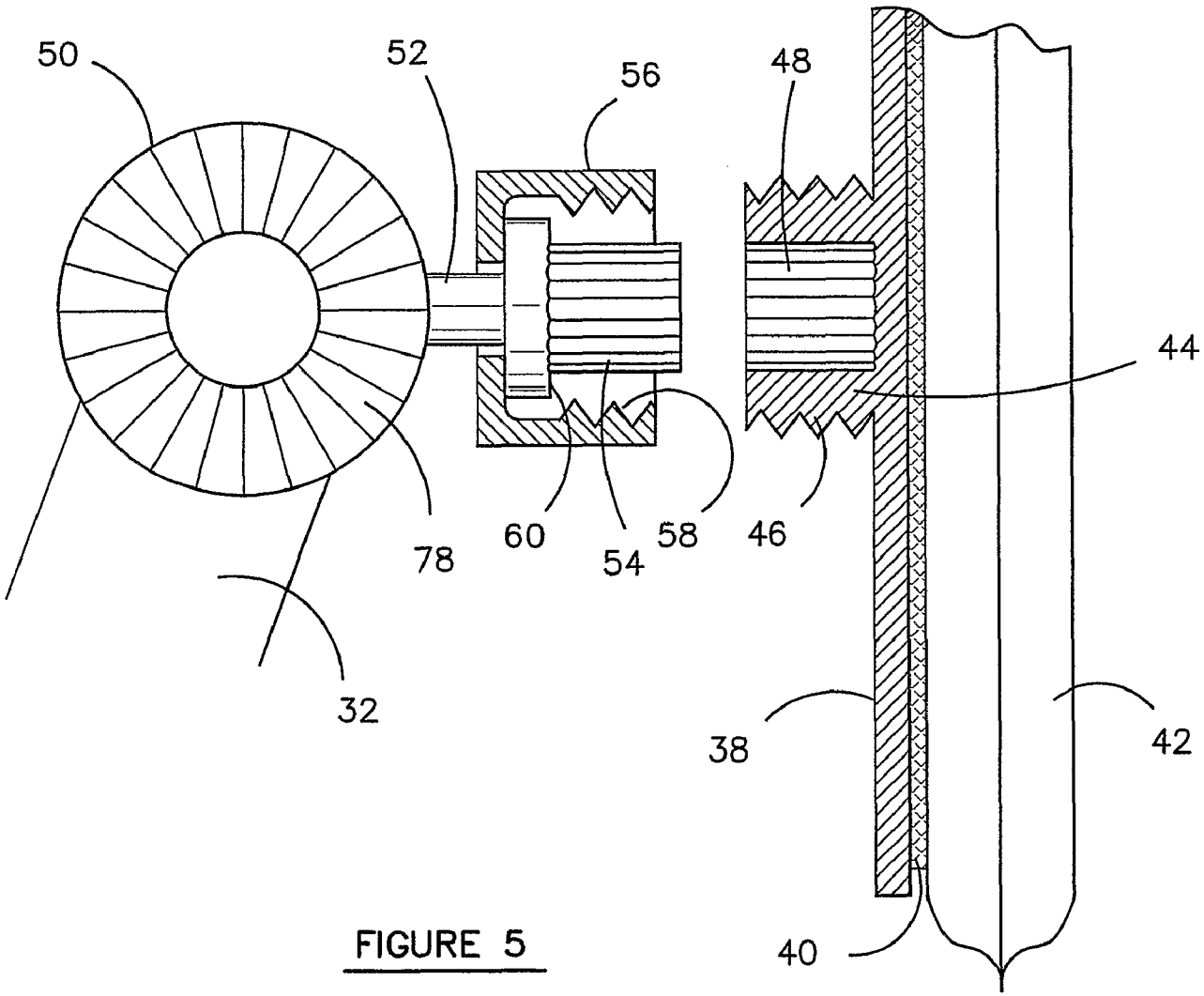
FIG. 5 is a sectional view of the pad plate and its connection to the device.

In FIG. 5, the teeth 78 which number 36, are of shallow V-section, having an apex angle of 120°. The crests of the teeth are slightly flattened to assist slippage. The teeth mate over their entire faces thereby reducing the load on each individual tooth.

Figure 7:
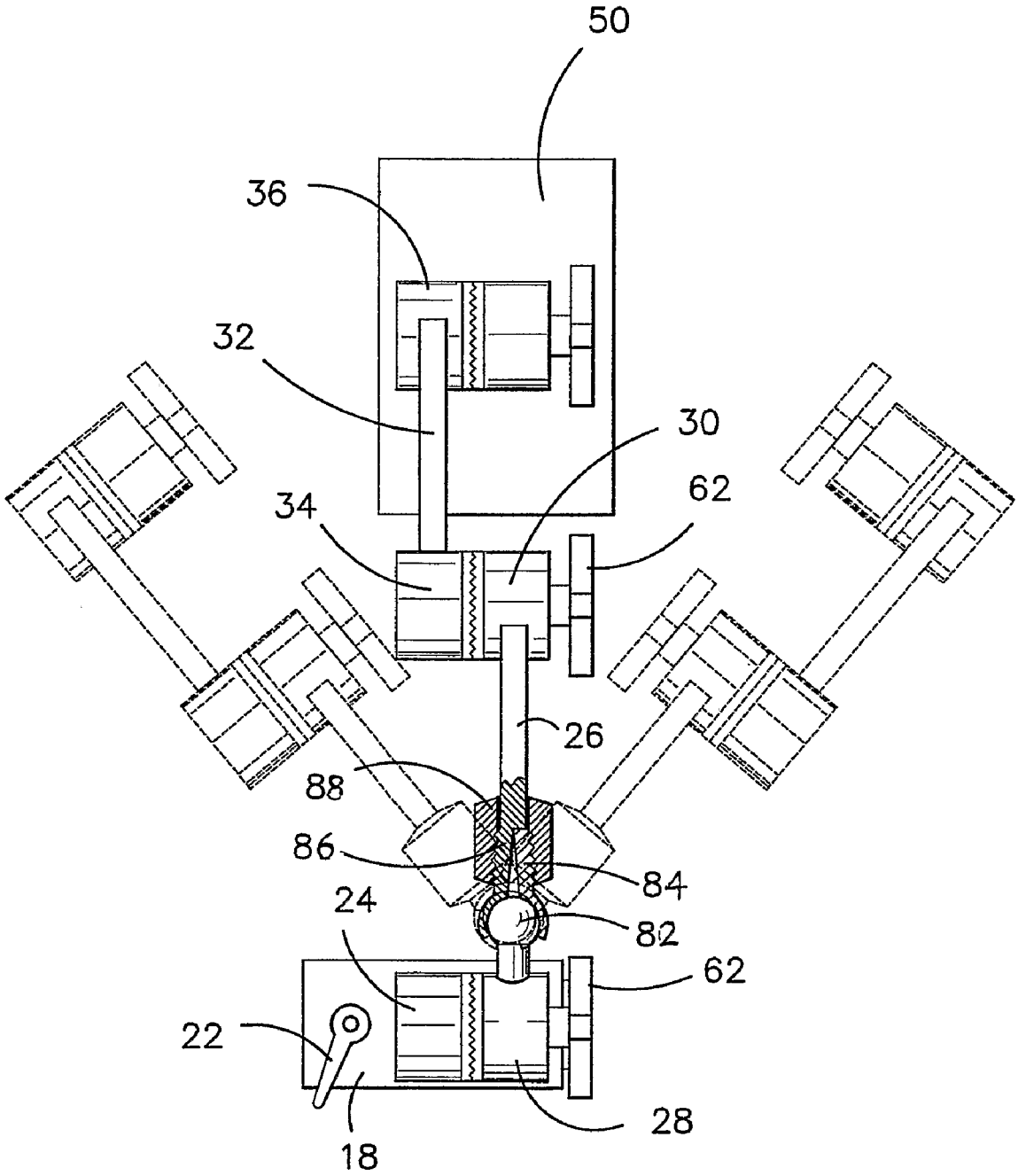
FIG. 7 is a side view of a variant device utilising ball clamps.
Figure 8:
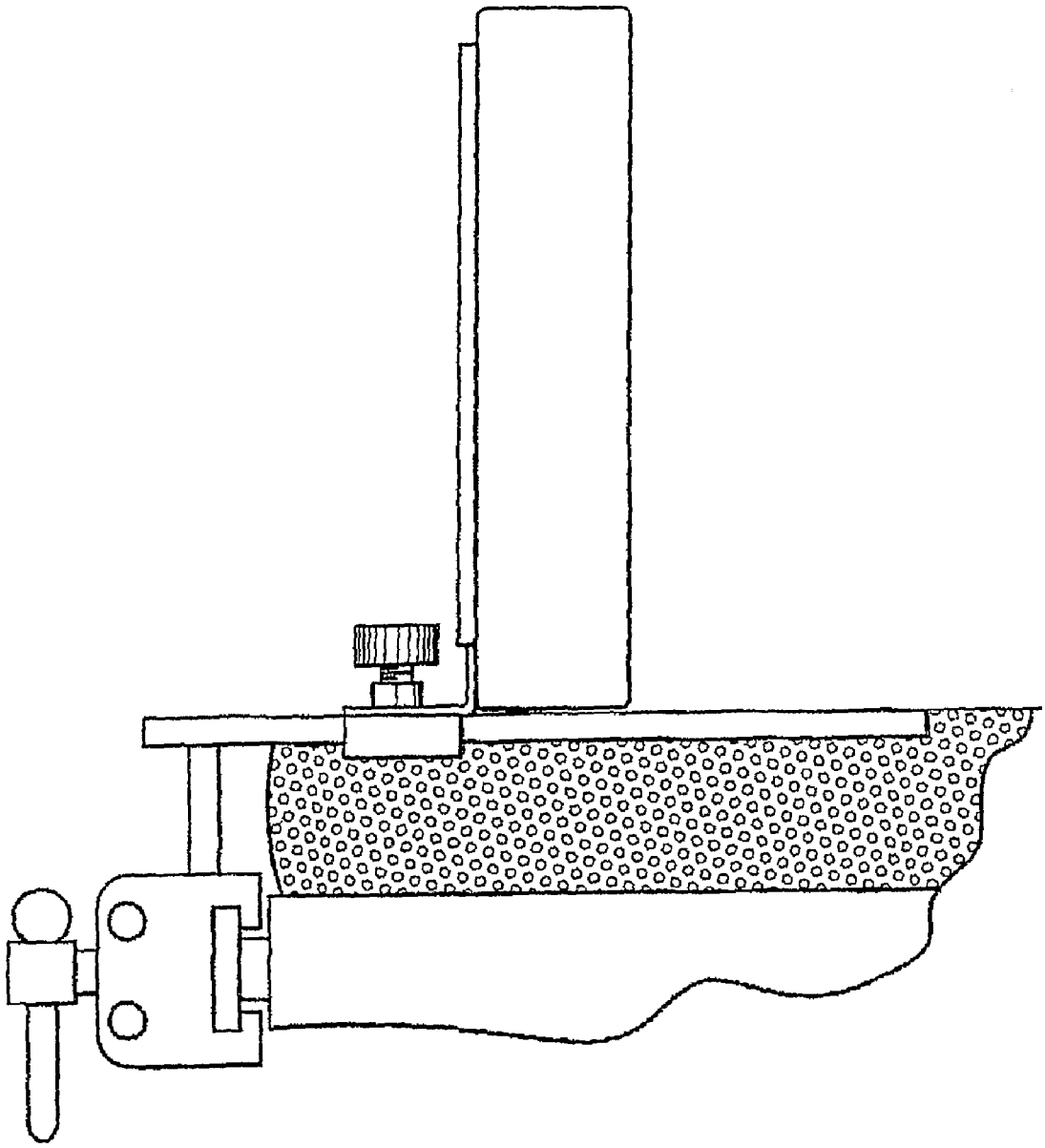
FIGURE 8 PRIOR ART
FIG. 8 shows a prior art device.

In FIG. 7, a variant allows the device to tilt in two directions at right angles while still allowing rotation toward and away from the table. Steel ball 82 is mounted on ring 28. Lower arm 26 is modified by substitution of a bifurcated clamp 84. The clamp embraces ball 82. The bifurcation has an exterior thread 86. Clamping nut 88 tightens the clamp around ball 82. In this way a limited range of universal motion is possible. This range may be improved by substitution of a second ball clamp at ring 34.

In use the arms are normally unlocked and parked beneath the table (see FIG. 1). The theatre staff slide the patient from the trolley on to the table and then turn the patient onto one side into the lateral or coma position. While the staff stand on both sides of the table, the arms are tilted to bring the pads on to the table beside the patient. The pads are moved into contact at the upper back, lower back, chest and abdomen at a suitable height. The angle of the pads are adjusted and the arms are each locked by turning the hand screws. The surface bactericide is topically applied and the patient is draped. If the patients position is to be changed, the hand screws are accessible through the drapes. The shape of the hand screws are easily felt even through the drapes and unlocking only requires rotation of 180°. The pads are adjustable to lie outboard of the table without disturbing the patient.

In a non-illustrated variant, the head plate of the table is removed allowing the patients head to overlie the end of the table. An end rail component is then clamped on the side rails of the table. A device as shown in FIG. 3 is then fixed to the end rail in the manner described. The pad plate is unscrewed and a neural head support is screwed to the nut 56. The head support clamps the patients head.

We have found the advantages of the above embodiment to be:—

1. Reduces the incidence of back injury in theatre staff.
2. The patient can be moved quickly to the resuscitation position; preparation or set up time is reduced.
3. The surgical drapes can stay in place if pad adjustment during the operation is necessary.
4. Falls from the table by patients can be reduced or eliminated.

It is to be understood that the word "comprising" as used throughout the specification is to be interpreted in its inclusive form, ie. use of the word "comprising" does not exclude the addition of other elements.

It is to be understood that various modifications of and/or additions to the invention can be made without departing from the basic nature of the invention these modifications and/or additions are therefore considered to fall within the scope of the invention.

The claims defining the invention are as follows:

1. A patient support device for an operating theatre table having an integral rail alongside at least part of a table edge, the device comprising means to engage the rail, support means pivotally connected at one end to the rail engagement means and at an opposite end to a pad for contacting a patient's body, means for locking the support means in positions where the pad is overlying the table, further from the table than the rail and below the table, wherein the support means is a pair of arms, the upper arm being pivotally connected to the pad, the lower arm being pivotally connected to the rail engaging means and each arm being pivotally connected to the other, and further wherein the pivots all allow rotation of the parts only about mutually parallel axes that are parallel to a longitudinal axis of the table, and wherein the means for locking includes radial arrays of teeth which engage and disengage and a screw actuator assisted by a spring which allows the radial arrays to rotate for angular adjustment by sliding over each other while inter-engaged until the radial arrays are locked.

2. A patient support device as claimed in claim 1, wherein the pad comprises a rigid pad plate covered on one face with a resilient layer.

3. A patient support device as claimed in claim 2, wherein the resilient layer is secured to the plate face with hook and pile fabric fasteners.

4. A patient support device as claimed in claim 1, wherein the support means is one of a cranked or curved arm.

5. A patient support device as claimed in claim 1, wherein the pad has a pivot with locking means for locking the pad at a desired angle.

6. A patient support device as claimed in claim 1, wherein the rail engaging means is a saddle with a clamp for locking the saddle in a desired position along the rail length.

7. A patient support device as claimed in claim 6, wherein the pad comprises a rigid pad plate, the upper arm has a ring at each end, the lower arm has a ring at each end, the rigid pad plate has a mounting ring, the saddle has a mounting ring and the rings are connected in pairs by the locking means to form pivots.

8. A patient support device as claimed in claim 7, wherein one ring has one of the radial arrays of teeth and the opposite ring has another of the radial arrays of teeth.

9. A patient support device as claimed in claim 8, wherein the arrays of teeth are provided on separate toothed rings which engage the rings of the upper and lower arms in order to rotate therewith.

10. A patient support device as claimed in claim 9, wherein the teeth are of shallow V-section.

11. A patient support device as claimed in claim 10, wherein a tooth angle is 80-150°.

12. A patient support device as claimed in claim 7, wherein a coupling connects the pad plate to the ring of the upper arm, the coupling comprising coaxially overlapping threaded sleeves which secure the pad plate to the ring and which sleeves enclose male and female splined members, one being connected to the ring, the other being connected to the pad plate, whereby the plate is rotatable and lockable in a selected position in relation to the patient's body.

13. The device of claim 1, wherein the upper arm has a fixed length and the lower arm has a fixed length.

14. A patient support device for an operating theatre table having an integral rail alongside at least part of a table edge, the device comprising:

means to engage the rail comprising a slide and a first pivot;

support means pivotally connected at one end to the rail engagement means and at an opposite end to a second pivot for mounting a surgical accessory, the support means including a first link connected at one end to the first pivot and at an opposite end to a third pivot, a second link connected at one end to the second pivot and at an opposite end to the third pivot, each pivot having a clamp for selecting a desired angle of articulation, wherein the first, second, and third pivots all allow rotation of connected parts only about mutually parallel axes, the mutually parallel axes being parallel to a longitudinal axis of the operating theatre table, and means for locking the three pivots in positions where the surgical accessory is overlying the table, further from the table than the rail and below the table, the means for locking including radial arrays of teeth which engage and disengage and a screw actuator assisted by a spring which allows the radial arrays to rotate for angular adjustment by sliding over each other while inter-engaged until the radial arrays are locked.

15. A patient support device as claimed in claim 14, wherein the accessory is one of a neuro head rest, a camera, a footrest, an arm board, a hip frame, an arthroscopy frame, a stirrup, a varicose vein stripper or a laparotomy retractor.

16. The patient support device of claim 14, wherein the second link includes a ring at each end, the first link includes a ring at each end, the second pivot includes a mounting ring, and the rings are connected in pairs by the locking means to the first, second, and third pivots.

17. The patient support device of claim 16, wherein the arrays of teeth are provided on separate toothed rings which engage the rings of the first and second links in order to rotate therewith.

18. The device of claim 14, wherein the first link has a fixed length and the second link has a fixed length.

19. A patient support device for an operating table, having an integral rail alongside at least part of a table edge, comprising a slide adapted to engage the rail of the operating table, a slide pivot fixed to the slide, a first arm connected at one end to the slide pivot and at the opposite end to an intermediate pivot, a pad support member with a surface for supporting a pad for a surgical patient, a pad pivot fixed to the pad support member, a second arm connected at one end to the pad pivot and at the opposite end to the intermediate pivot, each pivot having a clamp for selecting a desired angle of articulation, whereby the arms are capable of articulating to cause the pad to lie below the table or apposite a patient prone on the table, and wherein the slide pivot, intermediate pivot, and pad pivot all allow rotation only about mutually parallel axes that are parallel to a longitudinal axis of the table, and wherein each pivot includes radial arrays of teeth which engage and disengage and the clamp includes a screw actuator assisted by a spring which allows the radial arrays to rotate for angular adjustment by sliding over each other while inter-engaged until the radial arrays are locked.

20. A patient support device as claimed in claim 19, wherein a combined reach of the arms from the pad pivot to the slide pivot is 175-300 mm.

21. The device of claim 19, wherein the first arm has a fixed length and the second arm has a fixed length.

22. An apparatus, comprising:

a patient support device including means for engaging a rail of an operating theatre table, including a first pivot, support means pivotally connected at one end to the first pivot and at an opposite end to a second pivot for mounting a surgical accessory, the support means including a first link connected at one end to the first pivot and at an opposite end to a third pivot, a second link connected at one end to the second pivot and at an opposite end to the third pivot, each pivot having a clamp for selecting a desired angle of articulation, wherein the first, second, and third pivots all allow rotation of connected parts only about mutually parallel axes, the mutually parallel axes being parallel to a longitudinal axis of the operating theatre table;

means for locking the three pivots in positions where the surgical accessory is overlying the table, further from the table than the rail and below the table; and a surgical accessory configured for removable attachment to the patient support device, the surgical accessory comprising a spigot having splines and threads;

wherein the means for locking includes radial arrays of teeth which engage and disengage and the clamp includes a screw actuator assisted by a spring which allows the radial arrays to rotate for angular adjustment by sliding over each other while inter-engaged until the radial arrays are locked.

23. The apparatus of claim 22, wherein the patient support device further comprises a finger having splines and threads for mating with the splines and threads of the surgical accessory, the finger being connected to the second pivot.

24. The apparatus of claim 23, wherein the support means is one of a cranked or curved arm.

25. The apparatus of claim 23, wherein the second link includes an upper arm pivotally connected to the surgical accessory with the second pivot, the first link includes a lower arm pivotally connected to the rail engaging means with the first pivot and each arm is pivotally connected to the other with the third pivot.

26. The apparatus of claim 25, wherein the rail engaging means includes a saddle with a clamp for locking the saddle in a desired position along a length of the rail.

27. The apparatus of claim 26, wherein the upper arm includes a ring at each end, the lower arm includes a ring at each end, the finger includes a mounting ring, the saddle includes a ring, and the rings are connected in pairs by the locking means to the first, second, and third pivots.

28. The apparatus of claim 27, wherein one ring has one of the radial arrays of teeth and an opposite ring has another of the radial arrays of teeth.

29. The apparatus of claim 28, wherein the arrays of teeth are provided on separate toothed rings which engage the rings of the upper and lower arms in order to rotate therewith.

30. The apparatus of claim 29, wherein the teeth are of shallow V-section.

31. The apparatus of claim 30, wherein a tooth angle is 80-150°.

32. The apparatus of claim 22, wherein the first link has a fixed length and the second link has a fixed length.

* * * * *